US005125529A

United States Patent [19]

Torterotot

[11] Patent Number: 5,125,529

[45] Date of Patent: Jun. 30, 1992

[54] THERMOPLASTIC CONTAINER OPENED BY PARTIALLY PEELING BACK A MULTI-LAYERED TOP WHICH HAS BEEN HEAT-SEALED TO ITS EDGE, AND FILM FOR MULTI-LAYER TOPS

[75] Inventor: Roland Torterotot, Saint-Arnoult-en-Yvelines, France

[73] Assignee: Erca Holding, Les Ulis Cedex, France

[21] Appl. No.: 655,422

[22] PCT Filed: Jun. 27, 1990

[86] PCT No.: PCT/FR90/00473

§ 371 Date: Feb. 21, 1991

§ 102(e) Date: Feb. 21, 1991

[87] PCT Pub. No.: WO91/00228

PCT Pub. Date: Jan. 10, 1991

[30] Foreign Application Priority Data

Jun. 28, 1989 [FR] France ..... 89 08643

[51] Int. Cl.[5] ..... B65D 17/34

[52] U.S. Cl. ..... 220/270; 220/359; 215/232; 215/305; 215/298; 229/123.2; 229/125.35

[58] Field of Search ..... 220/359, 270; 215/232, 215/305, 298; 229/123.1, 123.2, 125.35

[56] References Cited

U.S. PATENT DOCUMENTS

| | | | |
|---|---|---|---|
| 3,547,338 | 12/1970 | Hemmes | 229/125.35 X |
| 3,632,004 | 1/1972 | Grimes et al. | 215/232 |
| 3,663,240 | 5/1972 | Seiferth et al. | 229/123.1 X |
| 4,381,848 | 5/1983 | Kahn | 229/123.2 X |
| 4,673,601 | 6/1987 | Lamping et al. | 229/123.1 X |
| 4,735,335 | 4/1988 | Torterotot | 220/359 X |
| 4,913,307 | 4/1990 | Takata et al. | 220/359 X |
| 5,004,111 | 4/1991 | McCarthy | 215/232 |

FOREIGN PATENT DOCUMENTS

| | | |
|---|---|---|
| 0262652 | 4/1988 | European Pat. Off. . |
| 2551031 | 3/1985 | France . |
| 2585986 | 2/1987 | France . |
| 1577593 | 10/1980 | United Kingdom . |

*Primary Examiner*—Stephen Marcus
*Assistant Examiner*—Paul A. Schwarz
*Attorney, Agent, or Firm*—Notaro & Michalos P.C.

[57] ABSTRACT

The invention relates to a multi-layered thermoplastic container 1 opened by the partial peeling back of a multi-layer top 6 which has been heat-sealed onto the edge 3 of the container 1 including a peeling tab 7. The peeling tab 7 has a scalloped area cut into its edge 3 in such a way as to delimit a grip cavity which is open toward the side of the top 6 and of the edge 3, and, facing the area where the internal sheet 9 of the top 6 and the internal layer 4 of the container 1 meet. The intermediate sheet 10 has a tearing edge enabling the internal sheet 9 to be torn.

4 Claims, 3 Drawing Sheets

THERMOPLASTIC CONTAINER OPENED BY PARTIALLY PEELING BACK A MULTI-LAYERED TOP WHICH HAS BEEN HEAT-SEALED TO ITS EDGE, AND FILM FOR MULTI-LAYER TOPS

FIELD AND BACKGROUND OF THE INVENTION

The present invention relates to a multi-layered thermoplastic container opened by partially peeling back a multi-layered top heat-sealed to the edge of said container and comprising, from bottom to top, a tear-off, simple or complex, internal sheet permanently heat-sealed on the edge of said container, a simple or complex intermediate sheet provided with an opening for access or a curved line for incision or weakening for opening and firmly adhering to said internal sheet at least outside the zone defined by said access opening or at least partially closed curved incision line, as well as a simple or complex outer sheet adhering, on the one hand, in peelable manner, to the intermediate sheet outside said zone defined by the access opening or the curved incision line made in this intermediate sheet and, on the other hand, in firm and non-peelable manner, either directly to a part of the internal sheet traversing said access opening, or to the intermediate sheet inside the zone defined by said incision line, said container further comprising a peeling tab in order to facilitate grip of the outer sheet on the edge of said recipient thermoformed from a multi-layered thermoplastic band.

In the case of known containers of this type, the internal sheet of the multi-layered top is hermetically heat-sealed on the layer of thermoplastic material of same nature of the edge of the container with complex wall, with the result that it is not easy, if not difficult, and even impossible to grip the edge of said top in order to peel the outer sheet and reveal the opening giving access to the container.

In order to facilitate grip of the outer sheet, and the beginning of the peeling thereof, it has already been proposed (FR 2 503 036) to make in a corner of the edge of the container provided with its top, from the lower face of said edge, a notch for weakening making it possible to break, by folding, said corner up to the outer sheet and to peel the latter from the intermediate sheet of said top. This modus operandi does not make it possible easily to provide the start of peeling at any point whatsoever of the edge of the container and, in addition, the operation of partial cutout or incision for making the notch can only be effected separately from the cutout of the containers and independently thereof.

Another known proposition for making a start of peeling (FR 2 551 031) consists in forming on an edge of the top between the intermediate sheet and the outer sheet thereof, a zone of non-adherence by a special treatment of non-adherence of one or the other of these two sheets. This treatment of non-adherence is expensive and the desired effects thereof are often destroyed during heat-sealing of the top on the edge of the container.

The edge of the top is crimped by the effect of cutout punches, in particular with the sharp profile necessary for the multi-layers.

SUMMARY OF THE INVENTION

One object of the present invention is to eliminate or at least attenuate these drawbacks and to propose a container of the type mentioned at the beginning, of which the outer sheet of the top may be easily gripped and peeled off.

This object is attained according to the invention in that the peeling tab comprises at least one shallow scalloping made either in the multi-layered top or in the edge of the container from the plane of heat-seal of the top on said edge, so as to define between the latter and the internal sheet of the top a narrow grip cavity open on the superposed edges of the top and of the edge and defined by the internal sheet of the top and an internal layer of the container constituted by a thermoplastic material firmly adhering by heat-seal to the internal sheet of the top and, facing the area where the internal sheet of the top and the internal layer of the container meet, the intermediate sheet of the top presents a tearing edge facilitating tear of the internal sheet of the top in the zone of the peeling tab, and peeling of the outer sheet of said top in order to reveal the opening for access.

Thanks to this concept, the outer sheet of the top may be gripped without difficulty and be peeled off after the internal sheet of said top has been torn in the peeling tab zone.

The invention also relates to a complex band containing a plurality of contiguous multi-layered tops and comprising, from bottom to top: a tear-off, simple or complex thermoplastic layer capable of being permanently heat-sealed on the edge of a thermoplastic multi-layered container, at the location of the internal layer of the latter; a simple or complex intermediate layer provided, above the opening of the container, with an opening for access cut out in said intermediate layer or defined by a curved line of incision at least partially closed and firmly adhering to said internal layer of said complex band, at least outside the zone defined by said access opening or said incision line, as well as a simple or complex outer layer adhering, on the one hand, in peelable manner, to the intermediate layer outside the zone defined by the access opening or the curved incision line made in this intermediate layer, and, on the other hand, firmly and in non-peelable manner, either directly to a part of the internal layer traversing said access opening, or to the intermediate layer inside the zone defined by said curved incision line, said complex band further comprising, in the marginal zone of each top, a peeling tab rendered accessible after cutout of the top and the edge of the container on which said top is heat-sealed.

The drawbacks of this type of complex band for tops have been mentioned hereinbefore in connection with the containers known by Patents FR 2 503 036 and 2 551 031.

Another object of the invention is to provide a complex band for tops making it possible to produce on the thermoplastic containers provided with tops fixed on the edge thereof by heat-welding or autogenous heat-sealing, a peeling tab which is easy to grip and which cannot be destroyed during said heat-sealing.

This object is attained according to the invention in that, in the zone of the peeling tab, the intermediate layer of the band is notched over the whole of its thickness at least on the border of said tab zone.

In that case, the internal layer of the top band not only adheres to the lower face of the intermediate layer as far as the side of the top which will be subsequently cut out from the complex band, but also covers the notch in the intermediate layer, and the grip cavity is then formed between the top with flat lower face and the zone of depression or scalloping made by thermoforming in the edge of the container at the location of the tab zone.

The object mentioned hereinbefore may also be attained according to the invention, when, in the zone of the peeling tab, the intermediate layer of the top band comprises a recess extending over the whole thickness of this intermediate layer and the internal layer adheres directly on the outer layer, the lateral wall of this recess comprising a tearing edge for said internal layer.

In that case, the edge of the container may present an entirely flat upper surface or comprise, at the location of the peeling tab zone, a zone of depression or of scalloping which is spaced apart from the heat-seal plane between the top and the edge of the container and which is made by thermoforming in the latter at the location of said tab zone.

BRIEF DESCRIPTION OF THE DRAWINGS

The object of the present invention will be more readily understood on reading the following description of several embodiments, description being made with reference to the accompanying drawings, in which.

DESCRIPTION OF THE PREFERRED EMBODIMENT

Figure 1:
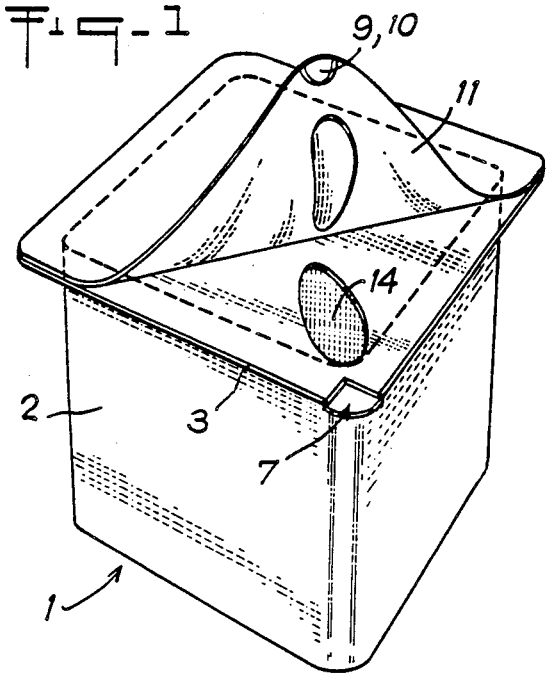
FIG. 1 is a view in perspective of a first embodiment of a container according to the invention, in which the peeling tab zone is provided in a corner of the edge of the container.
Figure 2:
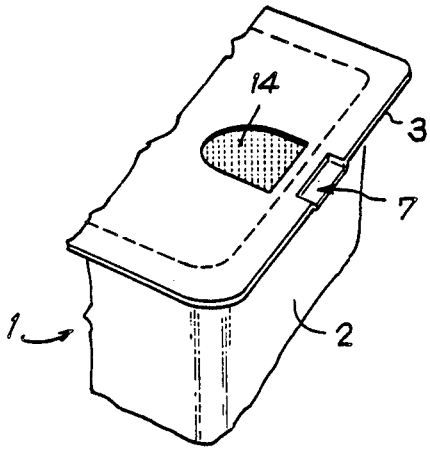
FIG. 2 is a view in perspective of part of a container of which the tab zone is provided in the middle of one side of the edge of the container.

As may be seen in the drawings, the thermoplastic container 1 obtained in known manner by thermoforming from a complex thermoplastic band (not shown), comprises a vertical wall 2 and a horizontal edge 3, the wall 2 and the edge 3 being constituted by an internal layer 4 and an outer layer 5 adhering firmly to each other, the internal layer 4 being for example made of polyethylene and the outer layer 5 of polyester. Of course, the materials constituting the container 1 may be modified without this signifying for the object of the invention, provided that the rules of the art are respected.

Figure 3:
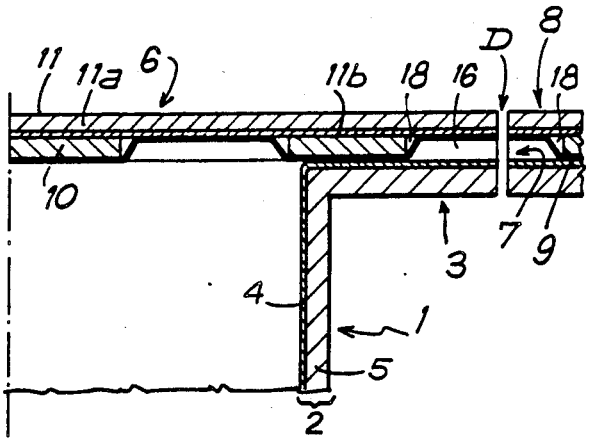
FIG. 3 is a partial view in elevation of a vertical axial section through a container of parallelepipedic shape and of part of the complex band with tops heat-sealed on the edge of said container, and showing a second embodiment of the tab zone.

A complex multi-layered or multi-sheet top 6 is heat-sealed on the edge 3 of the container 1 except for a peeling tab zone generally designated by reference 7. The complex top 6 is obtained by cutout (cf. arrow D of FIG. 3) from a complex, so-called top band 8 of which part is shown in FIG. 3. The top 6 or the top band 8 comprising a plurality of superposed sheets or layers which are, from bottom to top: an internal heat-sealable thermoplastic layer or sheet 9 of nature identical or similar to that of the internal layer 4 of the container 1, for example made of polyethylene; an intermediate sheet or layer 10 for example of polyester, adhering firmly to said internal sheet or layer 9; and an outer sheet or layer 11 made for example of an aluminium film 11*a* coated on its lower face with a thin film 11*b* of PVC or other appropriate material. The different sheets or layers 4, 5, 9, 10, 11 may be simple or complex layers, i.e. constituted by a plurality of thin films adhering more or less strongly to the adjacent films or layers.

Figure 7:
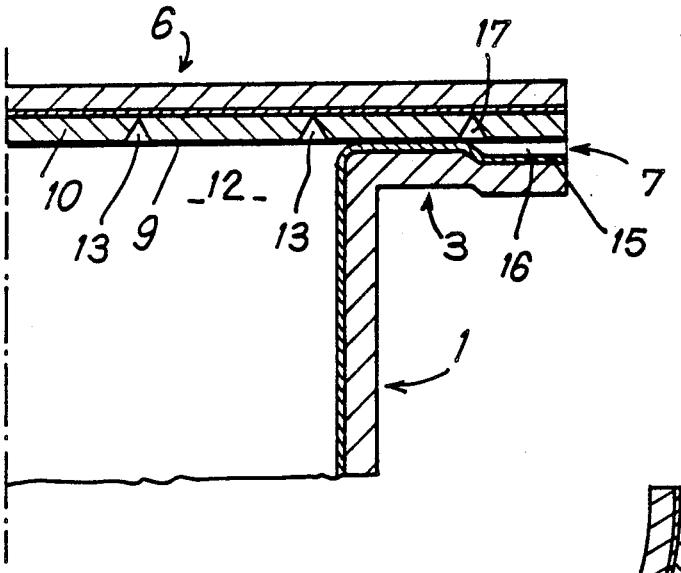
FIG. 7 is a partial view in elevation of a vertical axial section through a container and part of the top, showing the first embodiment of the tab zone.
Figure 8:
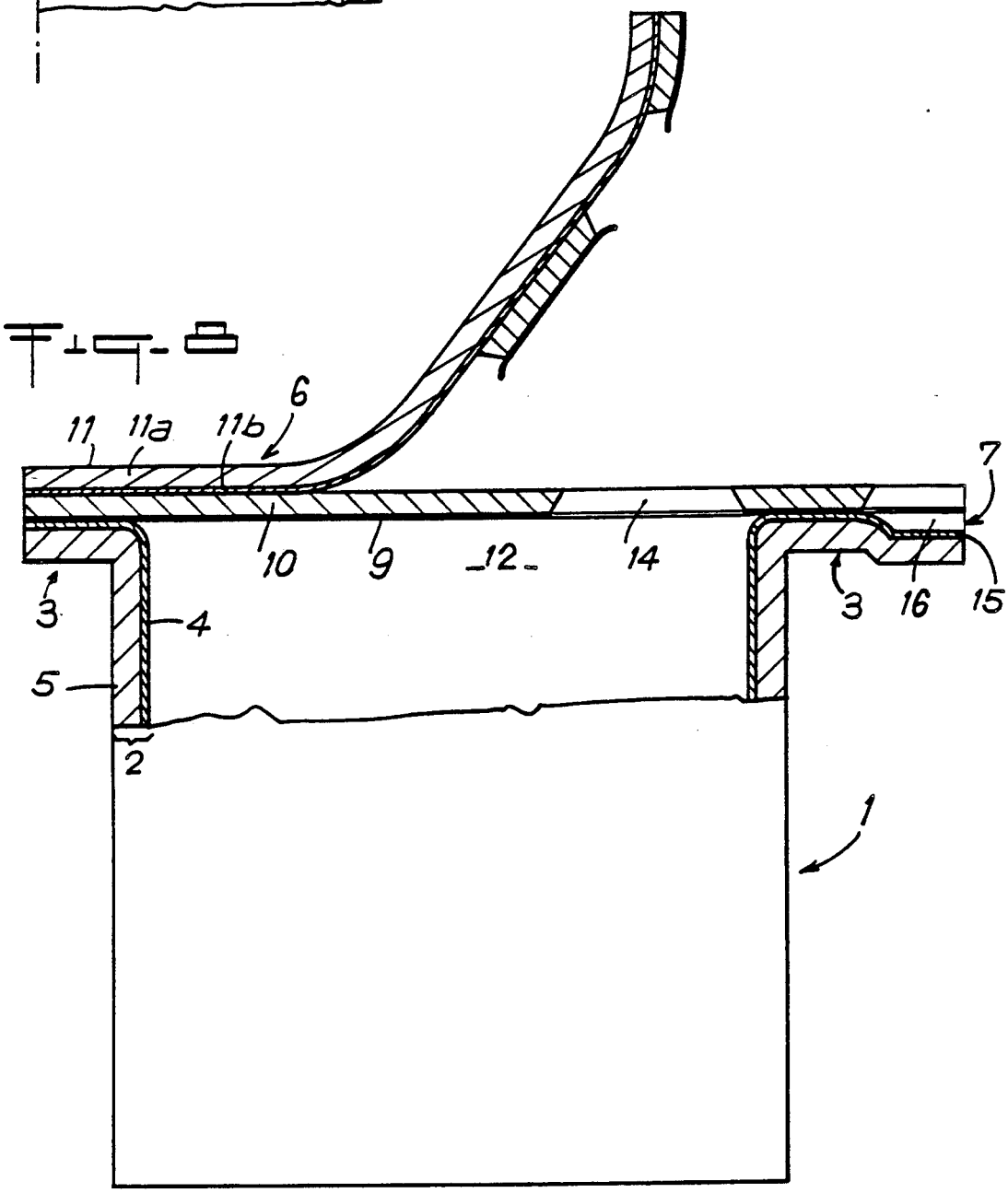
FIG. 8 is a view similar to FIG. 7 but with the outer sheet of the top partially peeled back.

According to the embodiment shown in FIGS. 1, 7 and 8, the top 6 and the top band 8 comprising a plurality of these tops juxtaposed and contiguous with respect to one another, present, above the upper opening 12 of the container 1, preferably near the vertical wall 2 thereof, a curved line of incision 13 at least partially closed on itself, and preferably entirely closed or contiguous, said line of incision 13 preferably made from bottom to top in the intermediate sheet or layer 10. This curved line of incision 13 forms access means for the container 1, and preferably extends over the whole thickness of the intermediate sheet 10 and presents for example a triangular transverse section of which the base is covered by the internal sheet 9 like the rest of the lower face of said sheet 10. It should be noted that the outer wall of the line of incision 13 defines the access opening 14 inside the container 1, access opening which will subsequently be completely revealed when the outer sheet 11 of the top 6 is peeled back, it being understood that the internal sheet 9 tears under the action of peeling along one of the tearing edges constituted by the lower and upper sides of the access opening 14. The thermowelding or heat-seal plane between the top 6 and the edge 3 of the container is horizontal and is defined on either side by the internal layer 4 of the container 1 and the internal sheet 9 of said top 6. For layer 4 and sheet 9, the same thermoplastic material is preferably used, enabling an autogenous heat seal to be produced, or at least a seal presenting the strongest of the adherences existing between two adjacent layers or sheets.

At the location of the peeling tab 7 which will be provided at the most appropriate spot and preferably in the immediate vicinity of the access opening 14 and at a sufficient distance from the vertical wall 2 of the container to allow correct and hermetic seal of the top 6 on the edge 3, the latter presents a shallow scalloping or depression 15 with respect to the heat-seal plane between edge 3 and top 6, this scalloping 15 being made, preferably by thermoforming, in edge 3 of container 1, preferably when the latter is formed (cf. FIGS. 1, 2 and 5 to 8).

Thanks to this measure, the top 6 is not sealed on the edge 3 at the location of the scalloping 15, but is sealed all around the latter, so as to define with said scalloping 15 a narrow grip cavity 16 open laterally on the superposed sides of the edge 3 and of the top 6. In the immediate vicinity of the bottom and sides of this cavity 16, namely facing the area where the internal sheet 9 of the top 6 and the internal layer 4 of the edge 3 meet, said meeting zone bordering the horizontal periphery of said cavity 16, the intermediate sheet 10 of the top 6 presents an incision for rupture or notch 17 which follows the periphery of the cavity 16 and which is preferably of triangular section of which the base is covered with the internal sheet 9 and overlaps at least partially the bottom of the cavity 16. The wall (outer with respect to the periphery of the cavity 16) constitutes by one of its sides a tearing edge on which the internal sheet 9 of the top 6 is torn (cf. FIGS. 5 to 8).

Of course, the access opening 14 which, in itself, does not form part of the subject matter of the invention, may be made differently by any access means, and in particular in the manner indicated in FIGS. 3 to 6. In that case, the access opening 14 is made by cutting out and eliminating a small plate in the intermediate sheet 10. This access opening 14 is covered on one side by the outer sheet 11 which remains substantially flat thereopposite and, on the other side, by the internal sheet 9 which penetrates in the opening 14 and adheres firmly on a large part of the transverse section of this opening 14, on the lower face of the outer sheet 11.

Figure 4:
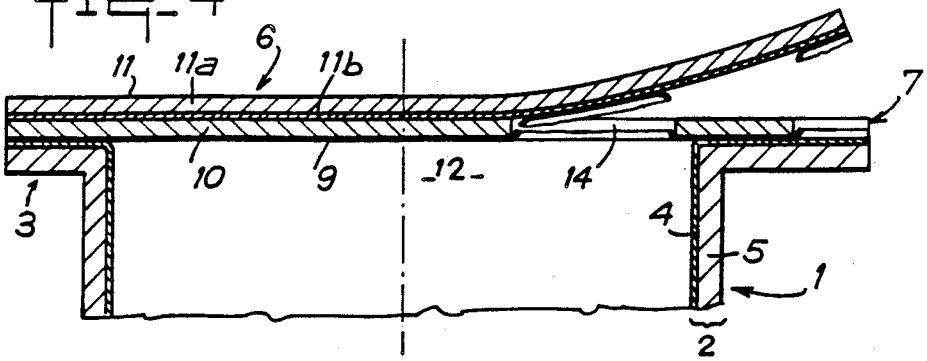
FIG. 4 is a view similar to FIG. 3 but with the outer sheet partially peeled back and the internal sheet torn at the locations of the tab zone and the access opening.
Figure 5:
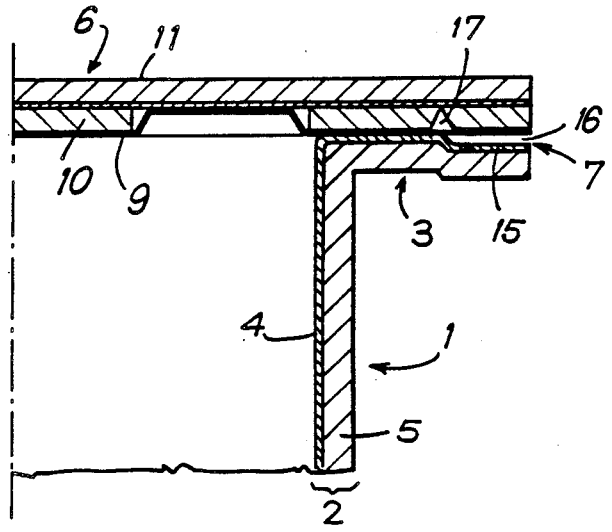
FIG. 5 is a partial view in elevation of a vertical axial section through a container and of a complex top heat-sealed on the edge of said container, and showing a third embodiment of the tab zone.
Figure 6:
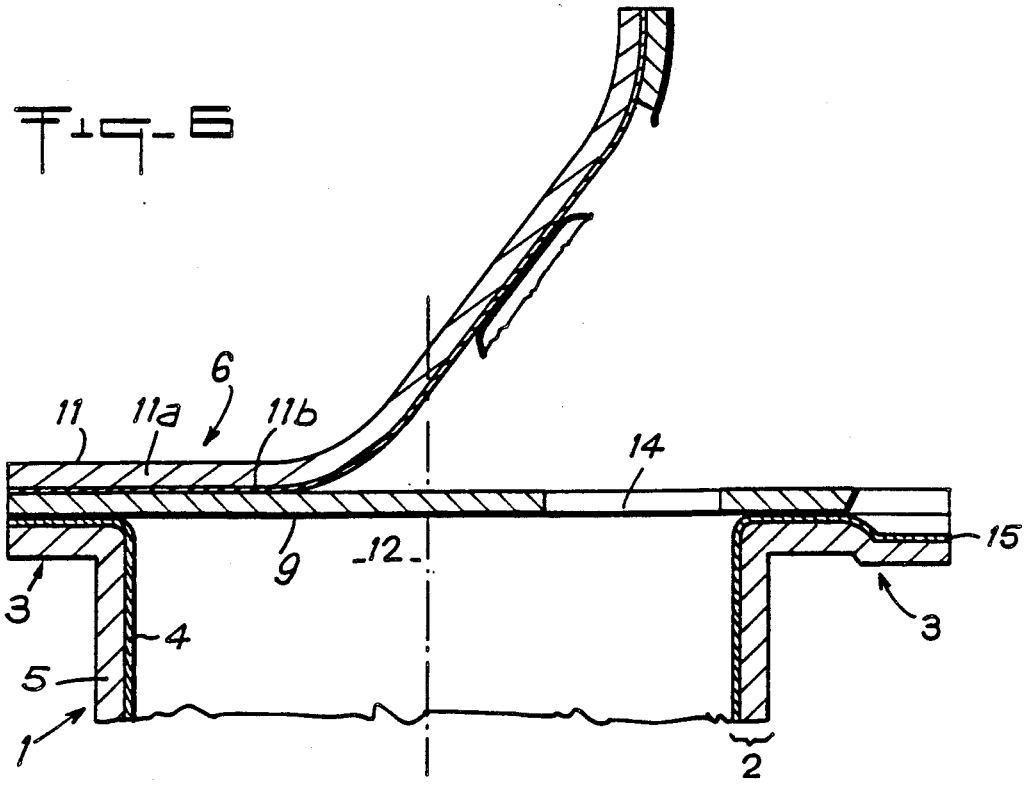
FIG. 6 is a view similar to FIG. 5 but with the outer sheet of the top partially peeled back.

The embodiment of the peeling tab 7 as shown in FIGS. 3 and 4 is preferably applied to an entirely flat edge 3, but may also be employed in combination with an edge 3 provided with a scalloping 15 (cf. FIGS. 5 to 8). According to FIGS. 3 and 4, the top 6 and the top band 8 comprise, at the location where the peeling tab 7 must subsequently lie, a cylindrical, truncated or like recess 18 which is of small diameter and which extends over the whole thickness of the intermediate layer 10 and which will overlap two contiguous edges of two adjacent containers 1 until the two containers 1 and the corresponding tops are cut out (cf. arrow D in FIG. 3). This recess 18 is covered, on the one hand, by the flat outer sheet or layer 11 of the adjacent tops 6 or of the top band 8 and, on the other hand, by the internal sheet or layer 9 which, at the location of the recess 18, passes therethrough over a large part of the transverse section of said recess 18 and adheres firmly to the lower face of the outer sheet or layer 11. After cut out of the edges of the two adjacent containers 1 at least at the location of the peeling tab 7, a grip cavity 16 is obtained, as in the previous examples, which is open on the superposed edges of the top 6 and of the edge 3 and defined, on the one hand, by a part of the internal sheet 9 of the top 6 and, on the other hand, by a part of the internal layer 4 of the edge 3, the bottom of this cavity 16 being constituted by the join by heat-sealing of the sheet 9 and the layer 4 and presenting a periphery in the form of a U open towards the edges of the container 1 and of the top 6. It should be noted that one of the edges of the vertical wall defining the recess 18 of the intermediate sheet 10 constitutes a tearing edge for the internal sheet 9 at the bottom of the grip cavity 16.

The subject matter of the present invention may be subject to a certain number of modifications without departing from the scope of protection defined by the accompanying claims.

We claim:

1. A multi-layered thermoplastic container (1) which is opened by partially peeling back a multi-layered top (6) heat-sealed at a heat-seal plane to an edge (3) of said container (1) and comprising, from bottom to top, a tear-off, internal sheet (9) permanently heat-sealed on the edge (3) of said container (1), an intermediate sheet (10) provided with access means for making an opening (14) into the container, said intermediate sheet being firmly adhering to said internal sheet (9) at least outside a zone defined by said access means, and an outer sheet (11) adhering in a peelable manner to the intermediate sheet outside said zone defined by the access means of said intermediate sheet (10), and in a firm and non-peelable manner to said internal sheet (9) inside the zone defined by said access means, said container (1) further comprising a peeling tab (7) for facilitating a gripping of the outer sheet (11) on the edge (3) of said container, said peeling tab being thermoformed from a multi-layered theremoplastic band, the improvement comprising:

the container (1) having an internal layer (4) constituted by a thermoplastic material and extending onto the edge (3);

the peeling tab (7) comprising at least one shallow depression (15) made in the edge (3) of the container (1) and from the heat-seal plane of the top (6) on said edge (3), so as to define between the edge and the internal sheet (9) of the top (6) a narrow grip cavity (16) open at superposed areas of the top (6) and the edge (3) and defined by the internal sheet (9) of the top (6) and by the internal layer 4 of the container (1), the internal layer (4) being firmly adhering by heat-seal to the internal sheet (9) of the top (6) at the edge (3) and away from said grip cavity (16); and facing an area where the internal sheet (9) of the top (6) and the internal layer (4) of the container (1) meet, the intermediate sheet (10) of the top (6) has a tearing edge facilitating tearing of the internal sheet (9) of the top (6) in the zone of the peeling tab (7), and peeling of the outer sheet (11) of said top (6) in order to reveal an opening (14) in the top formed by said access means.

2. In a multi-layered thermoplastic container (1) which is opened by partially peeling back a multi-layered top (6) heat-sealed at a heat-seal plane to a flat edge (3) of said container (1) and comprising, from bottom to top, a tear-off, internal sheet (9) permanently heat-sealed on the edge (3) of said container (1), an intermediate sheet (10) provided with access means for making an opening (14) into the container, said intermediate sheet being firmly adhering to said internal sheet (9) at least outside a zone defined by said access means, and an outer sheet (11) adhering in a peelable manner to the intermediate sheet outside said zone defined by the access means of said intermediate sheet (10), and in a firm and non-peelable manner to said internal sheet (9) inside the zone defined by said access means, said container (1) further comprising a peeling tab (7) for facilitating a gripping of the outer sheet (11) on the edge (3) of said container, said peeling tab being thermoformed from a multi-layered theremoplastic band, the improvement comprising:

the container (1) having an internal layer (4) constituted by a thermoplastic material and extending onto the edge (3);

the peeling tab (7) comprising a grip cavity (16) defined by the flat edge (3) of the container and by the internal sheet (9) of the top penetrating at the location of the tab (7) in a recess (18) made in the intermediate sheet (10) of the top (6) over the entire thickness of the intermediate sheet (10);

the internal sheet (9) penetrating in said recess (18) and adhered firmly to the outer sheet (11), and facing an area where the internal sheet (9) of the top (6) and the internal layer (4) of the container (1) meet, the intermediate sheet (10) of the top (6) having a tearing edge facilitating tearing of the internal sheet (9) of the top (6) in the zone of the peeling tab (7), and peeling of the outer sheet (11)

of said top (6) in order to reveal an opening (14) in the top formed by said access means.

3. A band (8) for forming a plurality of contiguous multi-layered tops (6) for use with a thermoplastic multi-layered container (1) having a main opening (12), an edge (3) around the main opening and an internal layer (4) each top (6) being cuttable from a next top in said band at a marginal zone of each top (6), the band comprising, from a bottom to an upper side of the band:

a tear-off, thermoplastic layer (9) capable of being permanently heat-sealed on the edge (3) of the container (1), at a location of the internal layer (4);

an intermediate layer (10) provided above the main opening (12) of the container, and having access means for forming an access opening (14) into the container, said intermediate layer (10) being at least partially closed and firmly adhering to said internal layer (9) of said band (8), at least outside a zone defined by said access means; and an outer layer (11) adhering in a peelable manner, to the intermediate layer (10) outside the zone defined by the access means and firmly in a non-peelable manner, to a part of the internal layer (9) traversing said access means inside the zone of said access means;

said band (8) further comprising, in the marginal zone of each top (6), a peeling tab (7) rendered accessible after a cutting of the top (6) from the band, and at the edge (3) of the container (1) on which said top (6) is t be heat-sealed, in the zone of the peeling tab (7), the intermediate layer (10) of the band (8) being notched at a notch (17) and over its entire thickness at least on a border of said tab, and a tearing edge facilitating a tearing of the internal sheet (9), the internal sheet covering the notch in the intermediate layer (10).

4. A band (8) for forming a plurality of contiguous multi-layered tops (6) for use with a thermoplastic multi-layered container (1) having a main opening (12), an edge (3) around the main opening and an internal layer (4), each top (6) being cuttable from a next top in said band at a marginal zone of each top (6), the band comprising, from a bottom to an upper side of the band:

a tear-off, thermoplastic layer (9) capable of being permanently heat-sealed on the edge (3) of the container (1), at a location of the internal layer (4);

an intermediate layer (10) provided above the main opening (12) of the container, and having access means for forming an access opening (14) into the container, said intermediate layer (10) being at least partially closed and firmly adhering to said internal layer (9) of said band (8), at least outside a zone defined by said access means; and an outer layer (11) adhering in a peelable manner, to the intermediate layer (10) outside the zone defined by the access means and firmly in a non-peelable manner, to a part of the internal layer (9) traversing said access means inside the zone of said access means;

said band (8) further comprising, in the marginal zone of each top (6), a peeling tab (7) rendered accessible after a cutting of the top (6) from the band, and at the edge (3) of the container (1) on which said top (6) is heat-sealed, in the zone of the peeling tab (7), the intermediate layer (10) of the band (8) containing a recess (18) extending over the entire thickness of the intermediate layer (10) and the internal layer (9) adhering directly on the outer layer (11). said recess (18) having a lateral wall which comprises a tearing edge for said internal layer (9).

* * * * *